US005730223A

United States Patent [19]

Restarick

[11] Patent Number: 5,730,223

[45] Date of Patent: Mar. 24, 1998

[54] SAND CONTROL SCREEN ASSEMBLY HAVING AN ADJUSTABLE FLOW RATE AND ASSOCIATED METHODS OF COMPLETING A SUBTERRANEAN WELL

[75] Inventor: Henry L. Restarick, Kuala Lumpur, Malaysia

[73] Assignee: Halliburton Energy Services, Inc., Dallas, Tex.

[21] Appl. No.: 590,853

[22] Filed: Jan. 24, 1996

[51] Int. Cl.[6] ..... E21B 43/08

[52] U.S. Cl. ..... 166/380; 166/236; 166/235

[58] Field of Search ..... 166/227, 229, 166/235, 236, 296, 332.4, 334.4, 380

[56] References Cited

U.S. PATENT DOCUMENTS

| | | | |
|---|---|---|---|
| 163,749 | 5/1875 | Danforth . | |
| 1,202,515 | 10/1916 | Hardin et al. . | |
| 1,245,170 | 11/1917 | Andrews . | |
| 1,518,696 | 12/1924 | Layne | 166/296 X |
| 1,520,376 | 12/1924 | Verneuil . | |
| 1,594,788 | 8/1926 | McLaughlin et al. . | |
| 1,861,722 | 6/1932 | Searle . | |
| 2,090,180 | 8/1937 | Bryant | 166/5 |
| 2,681,111 | 6/1954 | Thompson | 166/235 |
| 3,095,041 | 6/1963 | Rasmussen | 166/235 |
| 5,249,626 | 10/1993 | Gibbins | 166/235 |
| 5,579,844 | 12/1996 | Rebardi et al. | 166/296 |

*Primary Examiner*—William P. Neuder
*Attorney, Agent, or Firm*—William M. Imwalle; J. Richard Konneker

[57] ABSTRACT

An adjustable flow rate screen assembly and associated methods of completing a subterranean well provide variable flow rates through downhole sand control screens without restricting access to the well and without requiring overly restrictive screens to be utilized in gravel packing operations. In a preferred embodiment, a screen assembly has a tubular restrictor housing with a flow passage formed thereon, a tubular ported housing having ports formed radially therethrough and providing fluid communication with the flow passage, and a tubular selector sleeve with an opening formed radially therethrough and permitting fluid communication with a selected one of the ports.

31 Claims, 5 Drawing Sheets

SAND CONTROL SCREEN ASSEMBLY HAVING AN ADJUSTABLE FLOW RATE AND ASSOCIATED METHODS OF COMPLETING A SUBTERRANEAN WELL

BACKGROUND OF THE INVENTION

The present invention relates generally to subterranean well completions and, in a preferred embodiment thereof, more particularly provides a sand control screen assembly with a downhole-adjustable flow rate.

Sand control screens are generally used in subterranean wells to prevent formation sand and other debris from entering the flow path of fluids being produced from the well. Formation sand is relatively fine sand that is typically swept into the flow path of the produced fluids as the fluids flow out of the formation and into the well. As the fluid flow rate increases, a greater amount of formation sand is swept along with the fluids.

If produced, the sand causes many problems for a well operator. As the sand flows through production equipment, it gradually erodes the equipment. The sand also blocks flow passages, accumulates in chambers, and abrades seals. In short, formation sand is to be avoided in production of fluids from subterranean wells.

A common method utilized to prevent formation sand from entering the production equipment is to install a tubular sand control screen on a lower end of a string of production tubing, and position the screen in the well opposite the formation before producing the fluids. Unfortunately, the sand is still able to enter the well and accumulate about the screen and production tubing. It is much more desirable to prevent the formation sand from entering the well at all.

To minimize the amount of sand entering the well, operators typically rely on a process known to those skilled in the art as "gravel packing". A tubular screen is installed in the well as described above, and "gravel" (for example, relatively large grain sand, or glass or resin spheres) is deposited in the well between the screen and the formation. As the fluids are initially produced from the formation, the sand impinges upon the gravel and eventually "bridges off", preventing further production of formation sand.

The sand control screen keeps both the gravel and the formation sand from entering the production equipment during and after a gravel packing operation. The screen must have apertures which are large enough to permit a desired flow rate of fluids therethrough, but which are small enough to exclude the fine formation sand. To permit the desired fluid flow rate, several sand control screens are often interconnected, thereby increasing the effective flow area.

The well operator is, of course, interested in producing as much fluid from the well in as short a time as possible, without causing unacceptable damage to the well. However, as set forth above, increased flow rates typically cause an increase in produced formation sand which causes damage to the well. Therefore, a balance must be struck in each well completion design, between the economic incentive of increased production rates, and the economic disincentive of increased well damage caused by increased production of formation sand.

Because it is so costly and time-consuming to repair and replace production equipment, particularly downhole equipment perhaps located several thousand feet below the earth's surface, most well completion designs tend to overcompensate somewhat. Sand control screens are, therefore, usually specified for well completions such that the screens have the smallest apertures and lowest flow rates which may be anticipated as needed in the particular well. However, an appropriate flow rate at one portion or one time during the producing life of a well may be economically disadvantageous at other times and other portions of the well.

For example, when a sand control screen is being run into the well, it would be desirable to prevent wellbore fluids from flowing through the screen at all. The wellbore fluids, including "mud" and debris, tend to clog the screen, necessitating a flushing of the screen before the gravel packing operation. If the screen could be run into the well closed, and then opened when it is in position opposite the formation, rig time could be saved.

As a further example, a formation frequently spans hundreds of feet along the wellbore and many interconnected screens are used to provide a production flow path adjacent each portion of the formation. At times it would be advantageous to be able to adjust the flow rate of particular screens so that more or less fluids could be produced from particular portions of the formation. At other times, such as when a formation begins filling with water, it may be advantageous to completely close particular screens to minimize production of fluids from particular portions of the formation.

As yet another example, during initial production of fluids from a formation after a gravel packing operation it is usually desired to minimize the flow rate at the sand control screen. This is because the formation sand has not yet bridged off. If a large flow rate is initially used, a greater quantity of formation sand will be swept into the wellbore. Later, after the formation sand has bridged off, the flow rate should be increased for the most economical rate of production. It would be desirable to be able to control the flow rate through the screen, and to be able to do that at the screen, instead of at a remote valve, so that the wellbore is not itself blocked.

From the foregoing, it can be seen that it would be quite desirable to provide a sand control screen which permits the screen to be closed while being run in a well and then later opened for production of fluids therethrough, which permits variable rates of flow from various portions of a formation, and which permits the flow rate through the screen to be adjusted at the screen. It is accordingly an object of the present invention to provide such a sand control screen and associated methods of completing a subterranean well.

SUMMARY OF THE INVENTION

In carrying out the principles of the present invention, in accordance with an embodiment thereof, a tubular flow restrictor and screen assembly are provided which include a means of varying the flow rate of fluids through a screen, utilization of which does not require obstructing a wellbore in which the screen assembly is disposed, but which permits adjustment of the flow rate while the screen assembly is in the wellbore and remote from the earth's surface. In another aspect of the present invention, the flow rate through the screen may be adjusted to provide more or less fluid flow to or from selected portions of a formation, or to provide more or less fluid flow to or from multiple formations.

In broad terms, apparatus for variably restricting a flow rate therethrough of fluid from a fluid source is provided which includes first and second elongated and generally tubular members. The first tubular member has opposite ends and a circuitous flow passage formed on a side surface thereof. The flow passage has an effective flow passage length and a plurality of axially spaced apart portions. Each of the flow passage portions has a corresponding effective flow passage length less than the overall flow passage effective length.

The second tubular member is coaxially disposed relative to the first tubular member and is overlappingly disposed relative to the side surface thereof. The second tubular member has a sidewall portion and an opening formed through the sidewall portion, and is axially reciprocable relative to the first tubular member. The opening is thereby positioned axially opposite a selected one of the flow passage portions. The flow rate of the fluid through the apparatus may be conveniently varied by positioning the opening axially opposite a selected one of the flow passage portions to thereby select one of the corresponding flow passage portion effective flow passage lengths.

Apparatus operatively positionable in a subterranean wellbore for adjusting a fluid flow rate through a screen is also provided, the apparatus including a tubular restrictor housing, a ported housing, and a selector sleeve. The restrictor housing is capable of sealing attachment to the screen and has an axially extending flow passage formed thereon. The flow passage is in fluid communication with an interior side surface of the restrictor housing.

The ported housing is coaxially disposed within the restrictor housing and radially inwardly overlaps the restrictor housing. The ported housing has first and second ports formed radially therethrough, the first port being in fluid communication with the flow passage, and the second port being fluid communicable with the screen.

The selector sleeve is coaxially disposed within the ported housing, radially inwardly overlaps the ported housing, and is in axially sliding engagement therewith. The selector sleeve has an opening formed radially therethrough and has three positions: a closed position relative to the ported housing in which the opening is not axially aligned with either of the first and second ports, a flow restricted position in which the opening is axially aligned with the first port, and an open position in which the opening is axially aligned with the second port.

Also provided is a screen assembly operatively positionable in a subterranean well having a packer disposed therein. The screen assembly includes a tubular upper housing, a shifting sleeve, a ported housing, a selector sleeve, a screen, and a flow restrictor. The upper housing has opposite ends and an interior side surface, with one of the upper housing opposite ends being connectable to the packer. The upper housing further has an axially spaced apart series of circumferential recesses formed on the upper housing interior side surface.

The shifting sleeve has interior and exterior side surfaces and is coaxially and radially inwardly disposed relative to the upper housing. The shifting sleeve exterior side surface slidably engages the upper housing interior side surface. The shifting sleeve further has a circumferentially spaced apart series of collets formed thereon, which radially outwardly engage a selected one of the upper housing circumferential recesses.

The ported housing has opposite ends, interior and exterior side surfaces, and an axially spaced apart series of ports, each of the ports permitting fluid flow between the ported housing interior and exterior side surfaces. The ported housing is coaxially disposed relative to the upper housing and extends axially outward therefrom. One of the ported housing opposite ends is attached to the other one of the upper housing opposite ends.

The selector sleeve has opposite ends, an interior bore formed axially therethrough, an exterior side surface, and an opening permitting fluid flow between the selector sleeve exterior side surface and the interior bore. The selector sleeve is coaxially and radially inwardly disposed relative to the upper housing and the ported housing, the selector sleeve exterior side surface slidably engaging the ported housing interior side surface. One of the selector sleeve opposite ends is attached to the shifting sleeve for axial displacement therewith, and the selector sleeve opening is positionable axially opposite a selected one of the series of ports when the collets radially outwardly engage the selected one of the circumferential recesses.

The screen is radially outwardly and coaxially disposed relative to the ported housing. The screen is also radially spaced apart from the ported housing and defines an annular space radially intermediate the ported housing and the screen.

The flow restrictor is radially outwardly and coaxially disposed relative to the ported housing and is sealingly attached to an end of the screen. The flow restrictor is in fluid communication with the annular space.

A method of varying a fluid flow rate is also provided. A tubular member having a flow passage formed thereon is provided, a portion of the flow passage being in fluid communication with a side surface of the tubular member. Another tubular member is provided having an opening formed radially therethrough.

The second tubular member is coaxially and overlappingly disposed relative to the first tubular member side surface and the second tubular member is axially displaced relative to the first tubular member to thereby position the opening relative to the flow passage. The opening is then axially aligned with the portion of the flow passage to permit fluid communication between the opening and the flow passage.

Another method is provided by the present invention. This method is for adjusting a flow rate of fluid through a tubular screen disposed in a subterranean wellbore. A tubular restrictor housing is provided and an axially extending flow passage is formed on the restrictor housing, the flow passage being in fluid communication with an interior side surface of the restrictor housing. The restrictor housing is then sealingly attached to the screen.

A tubular ported housing is provided having first and second ports formed radially therethrough and coaxially disposed within the restrictor housing. The ported housing thereby radially inwardly overlaps the restrictor housing, the first port being in fluid communication with the flow passage, and the second port being in fluid communication with the screen.

A tubular selector sleeve is provided having an opening formed radially therethrough. The selector sleeve is then coaxially disposed within the ported housing, the selector sleeve radially inwardly overlapping the ported housing and being in axially sliding engagement therewith. The selector sleeve has a closed position relative to the ported housing in which the opening is not axially aligned with either of the first and second ports, a flow restricted position in which the opening is axially aligned with the first port, and an open position in which the opening is axially aligned with the second port. The selector sleeve is then axially displaced relative to the ported housing to a selected one of the three positions.

Yet another method is provided—a method of completing a subterranean well having a wellbore intersecting a formation. The method includes the steps of providing a tubular screen, providing a tubular flow restrictor capable of adjusting a flow rate of fluid through the screen, and sealingly attaching the screen to the flow restrictor, the flow restrictor extending axially outward from the screen. The flow restrictor is then closed to prevent fluid flow through the screen.

The screen and the flow restrictor are inserted in the wellbore and the screen is positioned opposite the formation. The flow restrictor is opened to thereby permit unrestricted fluid flow through the screen. The flow restrictor is then adjusted to restrict fluid flow through the screen such that the flow rate is less than the flow rate when the flow restrictor is open. The adjusting step is performed after the screen and flow restrictor are inserted in the wellbore.

The use of the disclosed screen assembly and associated methods of completing a subterranean well provide economic advantages in well completions, since the flow rate of fluids through a sand control screen may now be adjusted while the screen is positioned in the well, and the adjustment may be performed at the screen and without restricting subsequent access to the well.

DETAILED DESCRIPTION

In the following detailed description of the apparatus and method embodiments of the present invention representatively illustrated in the accompanying figures, directional terms such as "upper", "lower", "upward", "downward", etc. are used in relation to the illustrated apparatus and methods as they are depicted in the accompanying figures. It is to be understood that the apparatus and methods may be utilized in vertical, horizontal, inverted, or inclined orientations without deviating from the principles of the present invention. In addition, the following detailed description of the apparatus and method embodiments of the present invention relates specifically to gravel packing operations in subterranean wells, but it is to be understood that the disclosed apparatus and methods may be utilized in other operations, such as fracturing operations, wherein it is desired to regulate flow through a sand control screen.

Figure 1:
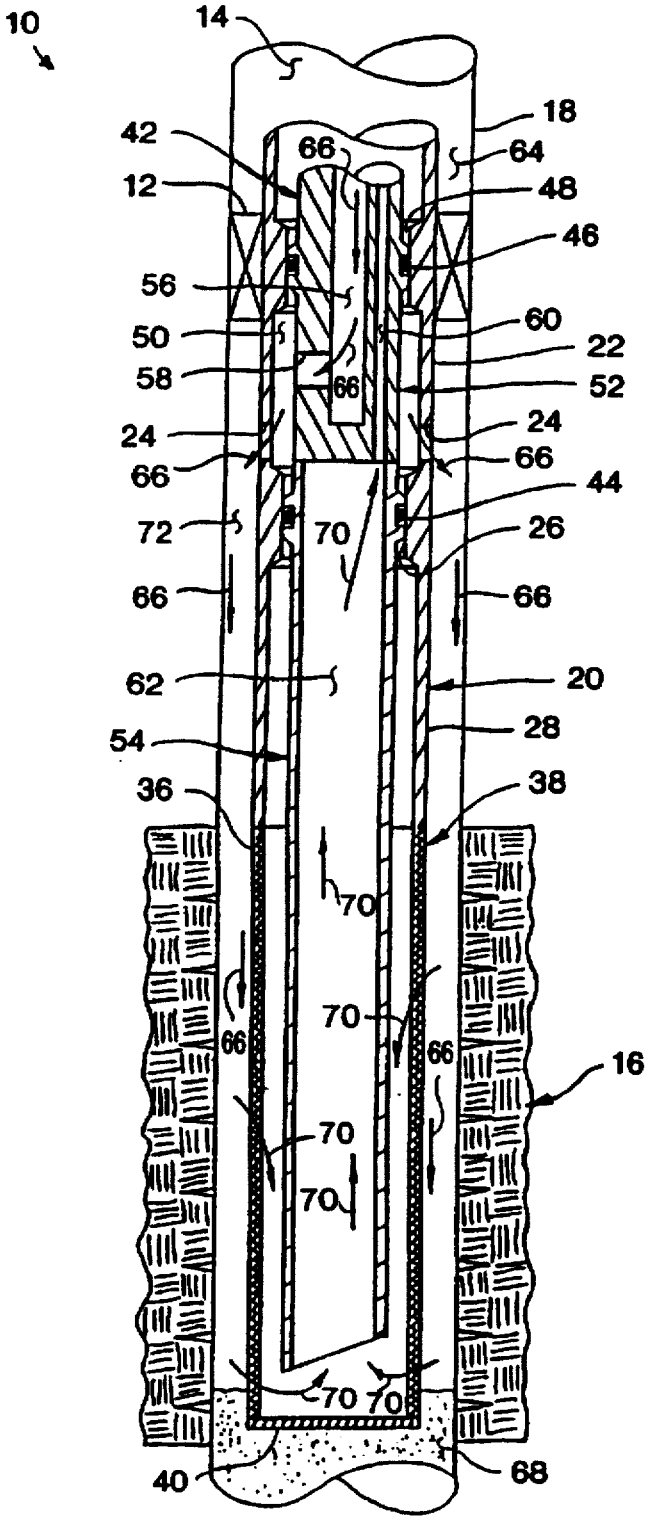
FIG. 1 is a cross-sectional view of a longitudinal portion of a subterranean well illustrating a method of completing the well in accordance with principles of the present invention.

Illustrated in FIG. 1 is a method of gravel packing a subterranean well 10 which embodies principles of the present invention. A packer 12 is set in a wellbore 14 which intersects a formation 16. The wellbore 14 is lined with protective casing 18, which has been perforated adjacent the formation 16 to thereby permit fluid communication between the formation and the wellbore 14 below the packer 12.

A tubular liner assembly 20 is attached to, and suspended from the packer 12. The liner assembly 20 includes, proceeding downwardly from the packer 12, an upper portion 22 having radially extending ports 24 formed therethrough, an axially extending inner seal bore 26, an intermediate portion 28, and a specially designed adjustable flow rate sand control screen assembly 38 having a lower plug 40. The liner assembly 20 is either run in the wellbore 14 attached to the packer 12, or may be separately run in the wellbore and attached to the packer after it has been set. The packer 12 is set in the casing 18 axially and upwardly displaced from the formation 16, such that the screen assembly 38 is disposed opposite the formation when the liner assembly 20 is attached to the packer.

A screen portion 36 of the screen assembly 38 is of conventional design and may be a wire-wrapped, sintered metal, or other type of screen typically utilized in gravel packing operations to prevent gravel pack material, formation sand, or other debris from entering the liner assembly 20. Screen assembly 38 is representatively illustrated in FIG. 1 as having one screen portion 36, but it is to be understood that any number of screen portions 36 may be utilized in the method 10. As the liner assembly 20 is run in the wellbore 14, the screen assembly 38 is in a closed configuration, preventing wellbore fluids from flowing inwardly through the screen portion 36.

A generally tubular tool string, known to those skilled in the art as a service tool string 42, is axially inserted in the packer 12 and liner assembly 20. The service tool string 42 may be run in the wellbore 14 coupled to the packer 12 and/or liner assembly 20, or may be run in the wellbore after the packer has been set in the casing 18. Preferably, the service tool string 42 is run in the wellbore 14 with the packer and liner assembly 20, such as is commonly done with the Multi Position Tool manufactured and sold by Halliburton Energy Services. The Multi Position Tool is described in U.S. Pat. No. 4,832,129 to Sproul et al., the disclosure of which is hereby incorporated by reference.

In a preferred mode of operation, the service tool string 42 may be axially displaced within the packer 12 and liner assembly 20. Axially spaced apart outer circumferential seals 44 and 46 on the service tool string 42 sealingly engage the internal seal bore 26 and an upper seal bore 48, respectively, such that ports 24 are axially intermediate the seal bores 26 and 48, and an annular cavity 50 is formed radially intermediate the liner assembly upper portion 22 and the tool string 42, and axially intermediate the seals 44 and 46.

The tool string 42 includes an upper crossover portion 52 and a lower washpipe portion 54. The crossover portion 52 has a central axial flow passage 56 formed therein, which extends partially through the crossover portion and which is in fluid communication with tubing (such as production tubing, not shown in FIG. 1) extending to the earth's surface. The flow passage 56 is also in fluid communication with the annular chamber 50 via radially extending flow port 58 formed on the crossover portion 52. A radially offset and axially extending circulation port 60 formed through the crossover portion 52 provides fluid communication between an axially extending interior washpipe bore 62 and an annular portion 64 of the wellbore 14 above the packer 12 and radially intermediate the casing 18 and the tubing extending to the earth's surface.

With the packer 12 set in the casing 18 and the screen assembly 38 positioned opposite the formation 16, the screen assembly is adjusted to an open configuration thereof, permitting substantially unrestricted flow of fluids inwardly through the screen portion 36. The service tool 42 is then disposed within the packer and liner assembly 20 as hereinabove described and a gravel pack slurry 66, including gravel 68 suspended in a fluid portion 70, is pumped downwardly through the tubing from the earth's surface. The slurry 66 enters the flow passage 56 in the crossover portion 52 and flows radially outward through flow port 58 and into annular cavity 50. From annular cavity 50, the slurry 66 flows radially outward through ports 24 into an annular space 72 below the packer 12 and radially intermediate the liner assembly 20 and the casing 18. The slurry 66 flows axially downward in annular space 72 until it eventually flows radially intermediate the screen assembly 38 and the casing 18 opposite the formation 16.

The fluid portion 70 of the slurry 66 is permitted to flow radially inward through the screen assembly 38, but the gravel 68 is excluded and, thus, accumulates in the wellbore 14. After the fluid portion 70 flows into the screen assembly 38, it enters the washpipe bore 62 and then flows axially upward through the washpipe portion 54 until it reaches the crossover portion 52. The fluid portion 70 next flows in the circulation port 60 axially upward through the crossover portion 52, and thence to the annulus 64 above the packer 12. The fluid portion 70 is returned to the earth's surface through the annulus 64. Thus, it can be seen that the slurry 66 is pumped downwardly from the earth's surface to the annular space 72 between the screen assembly 38 and the formation 16 where the gravel 68 accumulates and the fluid portion 70 passes through the screen portion 36. The fluid portion 70 is then circulated back to the earth's surface.

During initial stages of the method 10, gravel 68 accumulates about lower portions of the screen assembly 38 as shown in FIG. 1. Eventually, gravel 68 fills the entire annular space 72 between the screen 36 and the formation 16, and the slurry flow is stopped. The service tool string 42 is removed from the wellbore 14 and ports 24 are closed, using conventional procedures, leaving the liner assembly 20 in fluid communication with the tubing extending to the earth's surface.

The screen assembly 38 is then adjusted to a restricted flow rate configuration thereof, wherein flow is permitted through the screen portion 36, albeit at a reduced flow rate compared to the full open configuration of the screen assembly. Formation fluids are thus initially produced through the screen portion 36 at a restricted flow rate. This allows formation sand to adequately bridge off before the formation fluids are produced at a greater flow rate later.

When the formation sand has adequately bridged off, the screen assembly 38 is adjusted to a configuration having an ideal flow rate for the particular well characteristics. For example, where a formation has high permeability, a restricted flow rate may be required, and where a formation has low permeability, a relatively unrestricted, or full open, flow rate may be required for optimal economical production of the formation fluids. The screen assembly 38 provides flexibility in that the flow rate may be adjusted at the screen portion 36 and while the screen assembly is in position opposite the formation 16.

During the producing life of the formation 16, it may become necessary to induce a greater flow rate in selected portions of the formation, or to restrict flow from selected portions of the formation. If, as described above, multiple interconnected screen assemblies 38 span the length of the formation 16 in the wellbore, the screen assembly opposite the selected portion of the formation 16 may be adjusted as desired to influence the flow rate of fluids from that portion of the formation. Conversely, it may become necessary to inject fluids, such as acid, into selected portions of the formation 16. In that case, all of the screen assemblies 38 except the screen assembly opposite the selected portion of the formation may be closed to permit injection only through the open screen assembly. It will be readily apparent to one of ordinary skill in the art that other combinations of flow rate configurations may be utilized with multiple interconnected screen assemblies 38 in addition to those described above, in order to accomplish various desired objectives.

Figure 2A:
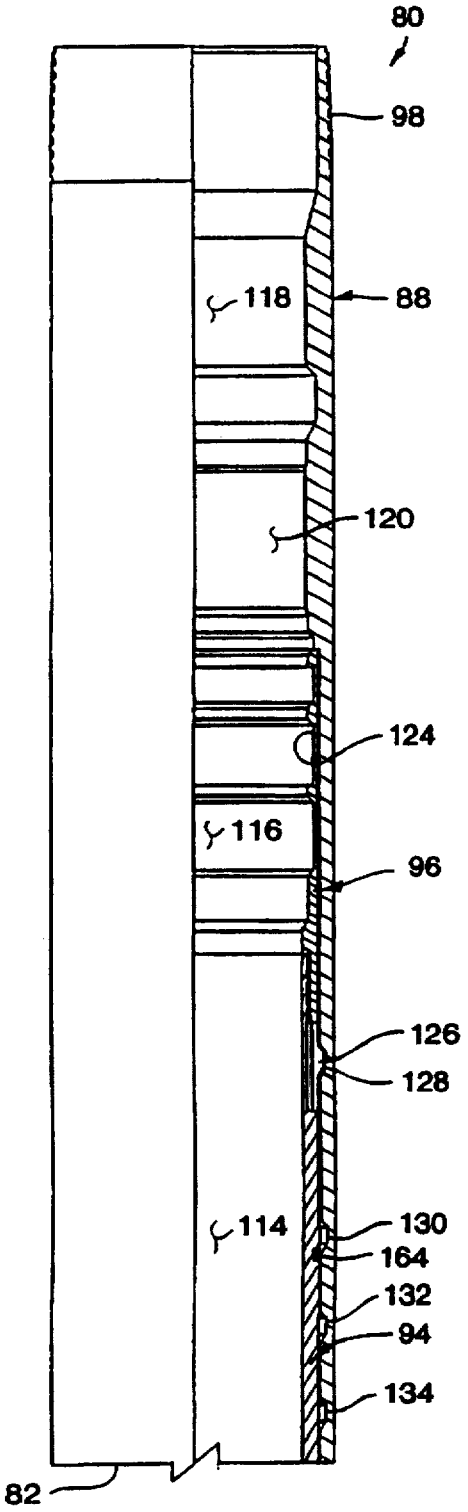
FIGS. 2A & 2B are enlarged scale quarter-sectional views through a sand control screen assembly embodying principles of the present invention, the screen assembly being configured in an open configuration thereof.
Figure 2B:
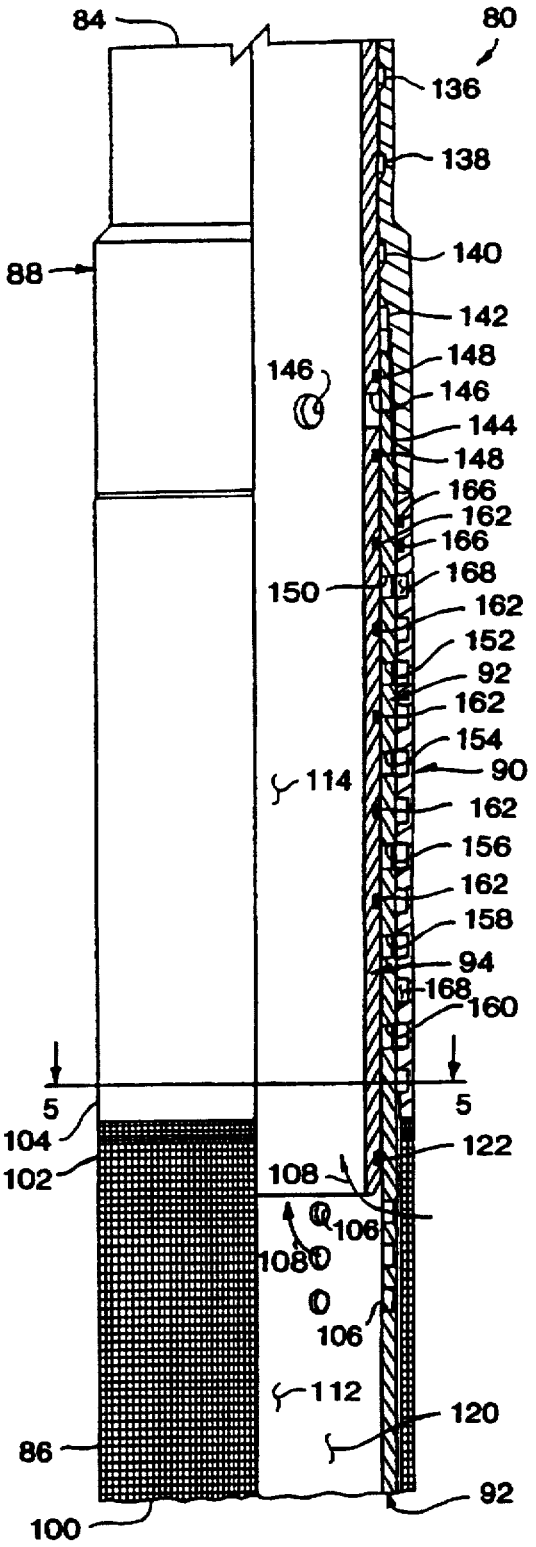

Turning now to FIGS. 2A and 2B, a sand control screen assembly 80 having an adjustable flow rate and embodying principles of the present invention is representatively illustrated. FIGS. 2A and 2B show upper and lower portions, respectively, of the screen assembly 80, end portion 82 of FIG. 2A being continuous with end portion 84 of FIG. 2B. Screen assembly 80 may be utilized to provide the unique functions of the screen assembly 38 in the method 10 representatively and somewhat schematically illustrated in FIG. 1.

FIGS. 2A and 2B show the screen assembly 80 in a fully open configuration thereof. In this configuration, the rate of fluid flow inwardly through a tubular screen portion 86 of the assembly 80 is relatively equivalent to the flow rate through the screen portion by itself. The novel manner in which the assembly 80 may be adjusted to variably restrict flow through the screen portion 86 will become apparent by consideration of the detailed description below.

The screen assembly 80 includes a tubular upper housing 88, a flow restrictor 90, a tubular ported lower housing 92, a tubular selector sleeve 94, and a tubular colleted shifting sleeve 96. Upper threaded end connection 98 permits the assembly 80 to be threadedly and sealingly interconnected to a liner assembly (such as liner assembly 20 shown in FIG. 1), another screen assembly 80, etc. Lower end portion 100 may be plugged (for example, by plug 40 as shown in FIG. 1) or may have a threaded end connection, similar to end connection 98, for interconnection with other equipment.

Screen portion 86 may be made of sintered metal, wrapped wire, or any material suitable for filtering formation sand, debris, gravel, or other solids from the fluid entering the screen assembly 80. Preferably, a wrapped wire screen is utilized for the screen portion 86 where high differential pressures across the screen portion are anticipated. An upper end 102 of the screen portion 86 is sealingly attached, preferably by welding, to a lower end 104 of the flow restrictor 90.

In the open configuration of the screen assembly 80 representatively illustrated in FIGS. 2A and 2B, fluid flow inwardly through the screen portion 86 does not also pass through the flow restrictor 90. Instead, fluid flow through the screen portion 86 passes inwardly through radially extending ports 106 (six of which are visible in FIG. 2B) formed through the ported housing 92. For convenience and clarity, in the remainder of the following detailed description of the screen assembly 80, fluid flow inwardly through the screen portion 86 will be assumed, although it is to be understood that fluid may flow outwardly through the screen portion without departing from the principles of the present invention.

Radially inwardly flowing fluid 108 passes through the screen portion 86 and enters an axially extending annular space 110 (see FIG. 5) between the screen portion and the coaxial and inwardly overlapping ported housing 92. With the screen assembly 80 in its illustrated open configuration, the fluid 108 is permitted to flow further inwardly through the ports 106. The fluid 108 next flows into an axially extending interior bore 112 of the ported housing 92 and into an axially extending interior bore 114 of the selector sleeve 114. Interior bores 112 and 114, along with interior bores 116 and 118 formed axially through the shifting sleeve 96 and upper housing 88, respectively, together define a flow passage 120 extending axially through the screen assembly 80.

Figure 5:
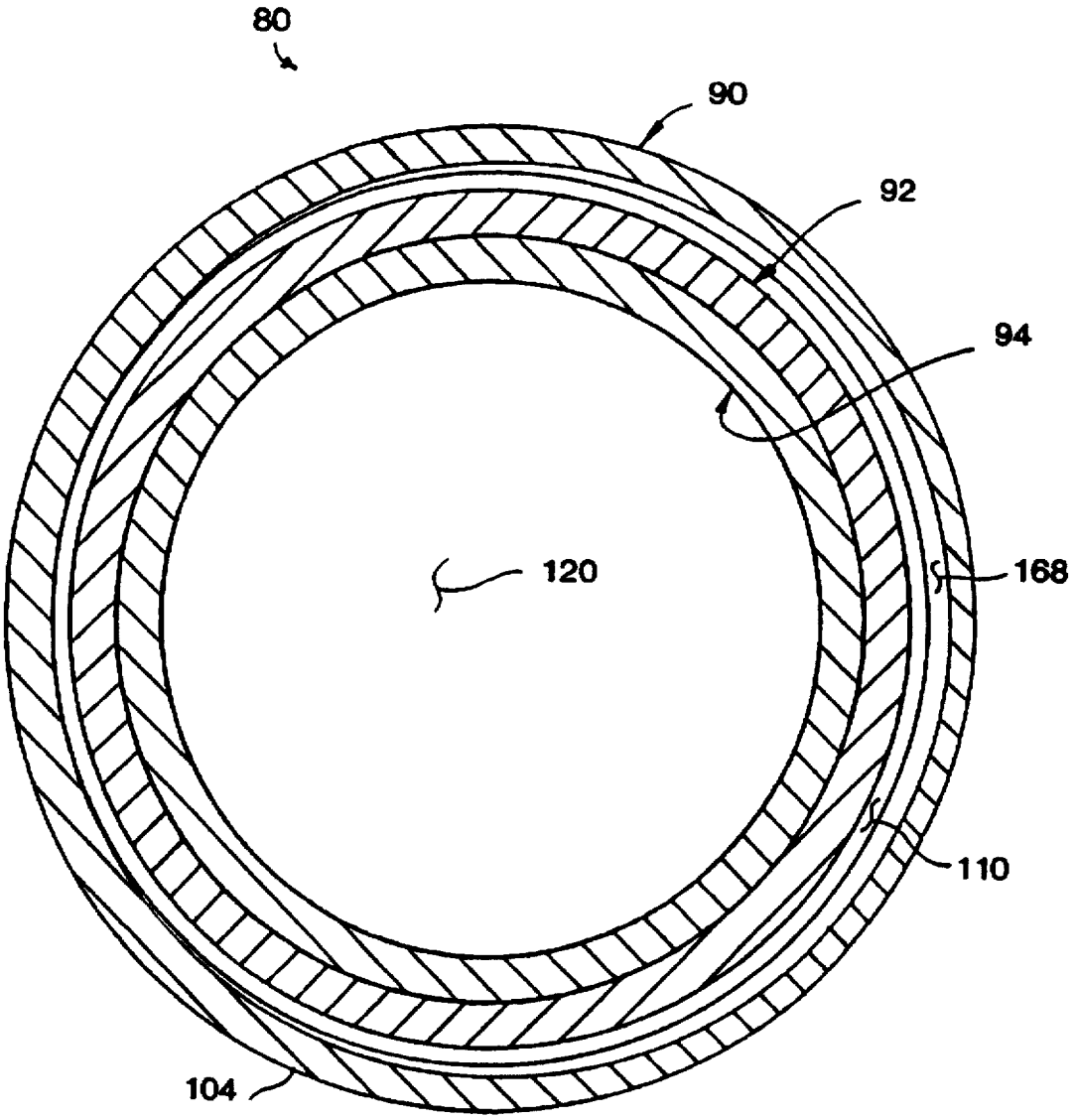
FIG. 5 is an enlarged scale cross-sectional view of the sand control screen assembly, taken along line 5—5 of FIG. 2B.

Referring additionally now to FIG. 5, a cross-sectional view through the lower end 104 of the flow restrictor 90 may be seen. Annular space 110 is radially intermediate coaxial flow restrictor 90 and ported housing 92. As will be more fully described below, a helical flow passage 168 intersects the annular space 110 in the flow restrictor 90 lower end 104.

Referring again to FIGS. 2A and 2B, selector sleeve 94 coaxially and radially inwardly overlaps the ported housing 92 and upper housing 88. The selector sleeve 94, as representatively illustrated in FIGS. 2A and 2B, has eight axial positions with respect to the ported housing 92. In the open configuration of the screen assembly 80, the selector sleeve 94 does not radially inwardly overlap the ports 106 on the ported housing 92. However, as will be further described below, in all other positions of the selector sleeve 94, ports 106 are radially inwardly overlapped by the selector sleeve, with circumferential seal 122 on the selector sleeve sealingly engaging the ported housing 92 and preventing direct fluid flow between the ports 106 and the flow passage 120.

The representatively illustrated eight axial positions of the selector sleeve 94 are selected by means of the shifting sleeve 96 which is coaxially and radially inwardly disposed relative to the upper housing 88. The shifting sleeve 96 is threadedly attached to the selector sleeve 94 and extends axially upward therefrom. The shifting sleeve 96 and selector sleeve 94 are, thus, together slidably engaged within the upper housing 88 and ported housing 92 and may be slidingly and axially reciprocated therein.

Shifting sleeve 96 has a shifting profile 124 formed internally thereon. The shifting profile 124 permits engagement of a conventional wireline or slickline shifting tool (not shown) therewith, for application of force to axially displace the shifting sleeve 96 and selector sleeve 94 within the screen assembly 80. As representatively illustrated in FIGS. 2A and 2B, the shifting sleeve 96 and selector sleeve 94 are in their uppermost position. It will be readily appreciated that sufficient axially downward displacement of the shifting sleeve 96 and selector sleeve 94 would cause seal 122 to pass axially over ports 106, thereby preventing flow of fluid 108 inwardly therethrough.

Shifting sleeve 96 has circumferentially spaced apart and radially outwardly biased collets 126 externally formed thereon. As representatively illustrated in FIG. 2A, the collets 126 are radially outwardly engaging an upper circumferential recess 128 which is cooperatively shaped to receive the collets therein. Such engagement of collets 126 in recess 128 acts to releasably secure the shifting sleeve 96 and selector sleeve 94 against axial displacement relative to the upper housing 88 and ported housing 92, maintaining the screen assembly 80 in its illustrated open configuration.

Additional axially spaced apart and radially outwardly extending circumferential recesses 130, 132, 134, 136, 138, 140, and a recess 142 formed adjacent a threaded and sealed connection 144 and axially intermediate the upper housing 88 and the ported housing 94, are formed internally on the upper housing. Axial displacement of the shifting sleeve 96 and selector sleeve 94 within the upper housing 88 and ported housing 92 is performed by engaging the shifting tool (not shown) in the shifting profile 124 and applying an upward or downward force as required to radially inwardly compress the collets 126 and move the shifting sleeve and selector sleeve axially upward or downward until the collets 126 radially outwardly expand into a desired circumferential recess 128, 130, 132, 134, 136, 138, 140, or 142.

Selector sleeve 94 has radially extending and circumferentially spaced apart selector ports 146 formed therethrough, two of which are visible in FIG. 2B. When the screen assembly 80 is in either of its open or closed configurations, selector ports 146 are radially outwardly overlapped by ported housing 92, and circumferential seals 148, which axially straddle the selector ports, sealingly engage the ported housing, thereby preventing flow of any fluid through the selector ports. When, however, collets 126 are engaged in either of recesses 130, 132, 134,136,138, or 140, selector ports 146 are axially aligned with a corresponding one of axially spaced apart and radially extending ports 150, 152, 154, 156, 158, and 160 formed through the ported housing 92. Each of ports 150–160 includes a series of circumferentially spaced apart openings formed through the ported housing 92, however, only one of each is visible in FIG. 2B.

Axially spaced apart circumferential seals 162 on the selector sleeve 94, along with lower seal 122 and an upper circumferential seal 164, sealingly engage the ported housing 92. It will be readily appreciated that, as the selector sleeve 94 is axially displaced within the ported housing 92, fluid flow is either permitted or prevented through the selector ports 146 and selected ones of the ports 106, 150, 152, 154, 156, 158, or 160 on the ported housing. The manner in which the fluid flow rate through the screen assembly 80 is thereby adjusted will be more fully understood upon consideration of the detailed description below.

Flow restrictor 90 coaxially and radially outwardly overlaps the ported housing 92. Circumferential seals 166 on the flow restrictor 90 sealingly engage the ported housing 92 axially above the ports 150. A helical flow passage 168 is internally formed on the flow restrictor 90 and extends axially downward from just below seals 166 to the annular space 110 (see FIG. 5) in lower end 104. As representatively illustrated in FIG. 2B, each of axially spaced apart series of ports 150–160 is axially aligned with an alternating one of the helical flow passage 168 turns. Thus, as selector ports 146 are progressively downwardly aligned with selected ones of ports 150–160, by engaging collets 126 in correspondingly selected ones of recesses 130–140 as described above, fluid 108 must flow through progressively shorter portions of helical flow passage 168 before flowing inwardly through the selector ports.

It is to be understood that helical flow passage 168 may have other shapes, more or fewer turns, etc. without departing from the principles of the present invention. For example, helical flow passage 168 may be a series of straight axially extending apertures of varying diameters, each of which is connected to one of ports 150–160. As another example, helical flow passage 168 may be a series of J-shaped passages which are interconnected to form longer or shorter flow paths depending on which of ports 150–160 are aligned with selector ports 146. It is also to be understood that ports 150–160 may be axially aligned with turns of helical flow passage 168 other than alternating turns, without departing from the principles of the present invention.

Figure 3A:
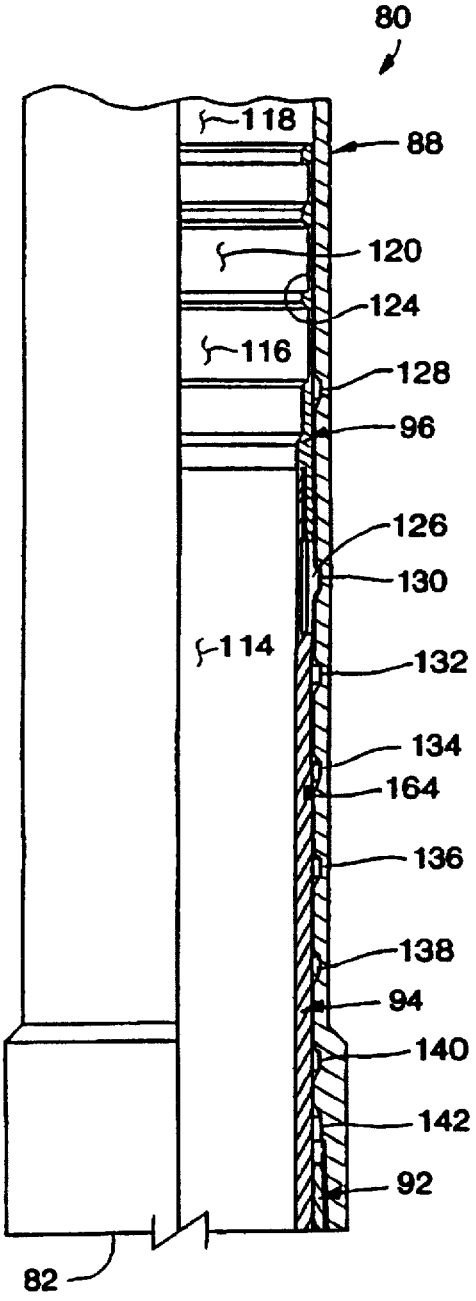
FIGS. 3A & 3B are enlarged scale quarter-sectional views of the sand control screen assembly, the screen assembly being configured in a restricted flow rate configuration thereof.
Figure 3B:
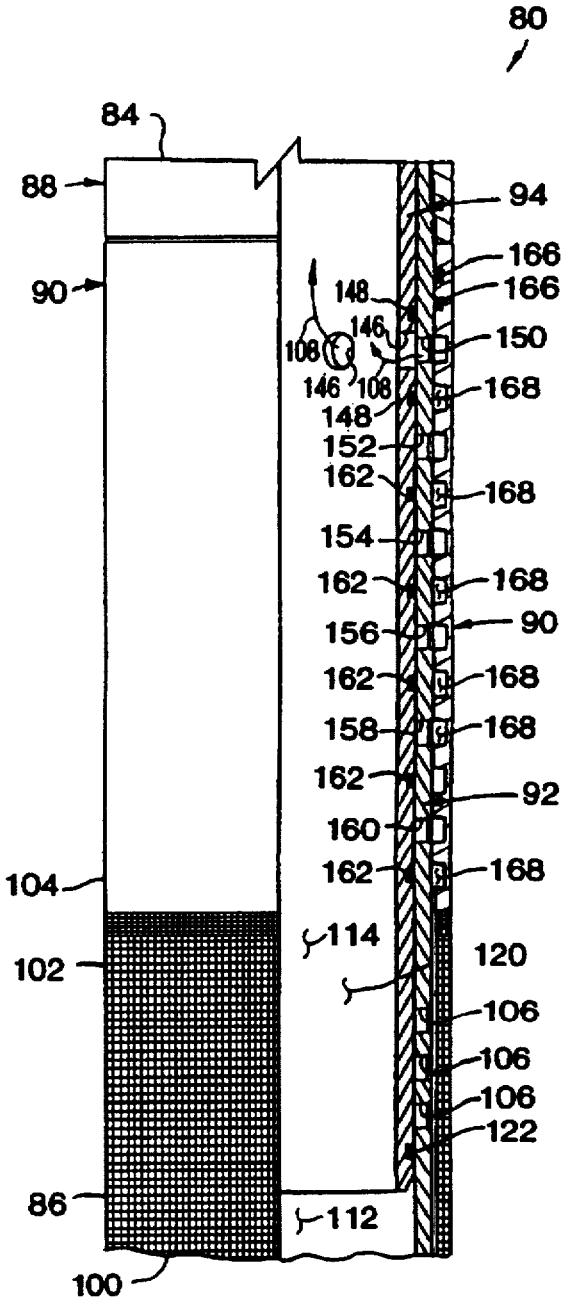

Turning now to FIGS. 3A and 3B, the screen assembly 80 is representatively illustrated in a restricted flow rate configuration thereof. As described above, the screen assembly 80 is in its restricted flow rate configuration when ports 106 on the ported housing 92 are closed by the selector sleeve 94, and the selector ports 146 on the selector sleeve 94 are aligned with a selected one of ports 150–160 on the ported housing.

Shifting sleeve 96 has been axially downwardly displaced relative to the upper housing 88 as compared to FIGS. 2A and 2B. Collets 126 are now radially outwardly engaged in recess 130 on the upper housing 88. Such downward displacement of the shifting sleeve 96 has also caused an axially downward displacement of selector sleeve 94.

Seals 148 on the selector sleeve 94 now sealingly engage the ported housing 92 axially straddling the uppermost ports 150. Fluid 108 may now flow spirally upward through the helical flow passage 168, inwardly through ports 150, through ports 146 on the selector sleeve 94, and into the flow passage 120. All ports on the ported housing 92, except for ports 150, are closed by the selector sleeve 94, permitting radially inward flow only through ports 150.

Fluid 108 which flows inwardly through screen portion 86 enters the annular space 110 (see FIG. 5) between the screen portion and the ported housing 92. The fluid 108 then flows axially upward into helical flow passage 168, entering the helical flow passage at the lower end 104 of the flow restrictor 90.

Note that the annular space 110 extends axially upward and intersects the helical flow passage 168 at the lower end 104 of the flow restrictor 90, but the annular space 110 does not extend any further upward. The flow restrictor 90 is only slightly larger radially than the ported housing 94 and is closely fit thereon, forcing the fluid 108 to flow through the helical flow passage 168, except at its lower end 104 where the annular space 110 intersects the helical flow passage.

With the selector sleeve 94 positioned as shown in FIGS. 3A and 3B, the fluid 108 must flow through substantially the entire length of the helical flow passage 168, from lower end 104 of the flow restrictor 90 to ports 150 on the ported housing 92. It will be readily appreciated that the fluid 108 must, therefore, flow a substantially longer distance through helical flow passage 168 when the screen assembly 80 is in its restricted flow rate configuration as shown in FIGS. 3A and 3B than when the screen assembly is in its open configuration as shown in FIGS. 2A and 2B and the fluid 108 is permitted to flow directly radially inward through ports 106.

Selector sleeve 94 may be further axially downwardly displaced relative to the ported housing 92, with the screen assembly 80 in its restricted flow configuration. For example, shifting sleeve 96 may be axially downwardly displaced to radially outwardly engage collets 126 in recess 132, thereby displacing selector sleeve 94 further downward relative to the ported housing 92. If collets 126 are thus engaged in recess 132, selector ports 146 will be axially aligned with ports 152, permitting the fluid 108 to flow inwardly through the ports 152 but preventing flow through all other ports on the ported housing.

Note that, with selector ports 146 aligned with ports 152, the fluid 108 is not forced to flow through substantially the entire length of the helical flow passage 168, resulting in a somewhat less restricted flow. Minimal flow restriction, with the screen assembly 80 in its restricted flow rate configuration, is achieved by axially downwardly displacing shifting sleeve 96 and engaging collets 126 in recess 140 on the upper housing 88, thereby aligning selector ports 146 with ports 160 on the ported housing 92.

Thus, the screen assembly 80 as representatively illustrated in FIGS. 3A and 3B has a series of six restricted flow rate positions of the selector sleeve 94, adjustable from a maximum flow restriction position wherein selector ports 146 are aligned with ports 150, to a minimum flow restriction position wherein selector ports 146 are aligned with ports 160. The amount of flow restriction is determined by the length of the helical flow passage 168 through which the fluid 108 is thereby forced to flow. It is to be understood that different quantities, proportions, and placements of flow restriction positions may be utilized without departing from the principles of the present invention.

Several benefits are derived from the unique features of the screen assembly 80 which enable the flow rate through the screen portion 86 to be adjusted as above described. For example, the screen assembly 80 eliminates the need to restrict the flow rate through the screen portion 86 elsewhere in the well by other methods, such as partially closing a valve on a wellhead which would also restrict access to the wellbore through the wellhead. As a further example, adjustment of the flow rate at the screen assembly 80 as described above permits more precise flow rate adjustment, since the effect of other factors on the flow rate, such as production tubing volume and flow area, are minimized. As yet another example, when multiple screen assemblies 80 are interconnected, each screen assembly may be individually adjusted to direct flow to or from a particular portion of a formation. It will be readily apparent to one of ordinary skill in the art that such adjustability of the flow rate through a downhole sand control screen has many other applications, giving greater flexibility in well completion designs and, thus, more economical production, than previously known.

Figure 4A:
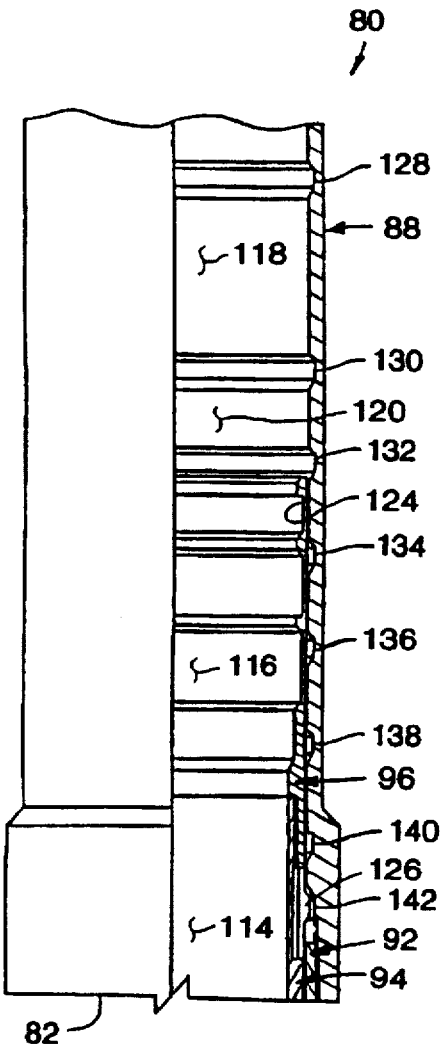
FIGS. 4A and 4B are enlarged scale quarter-sectional views of the sand control screen assembly, the screen assembly being configured in a closed configuration thereof.
Figure 4B:
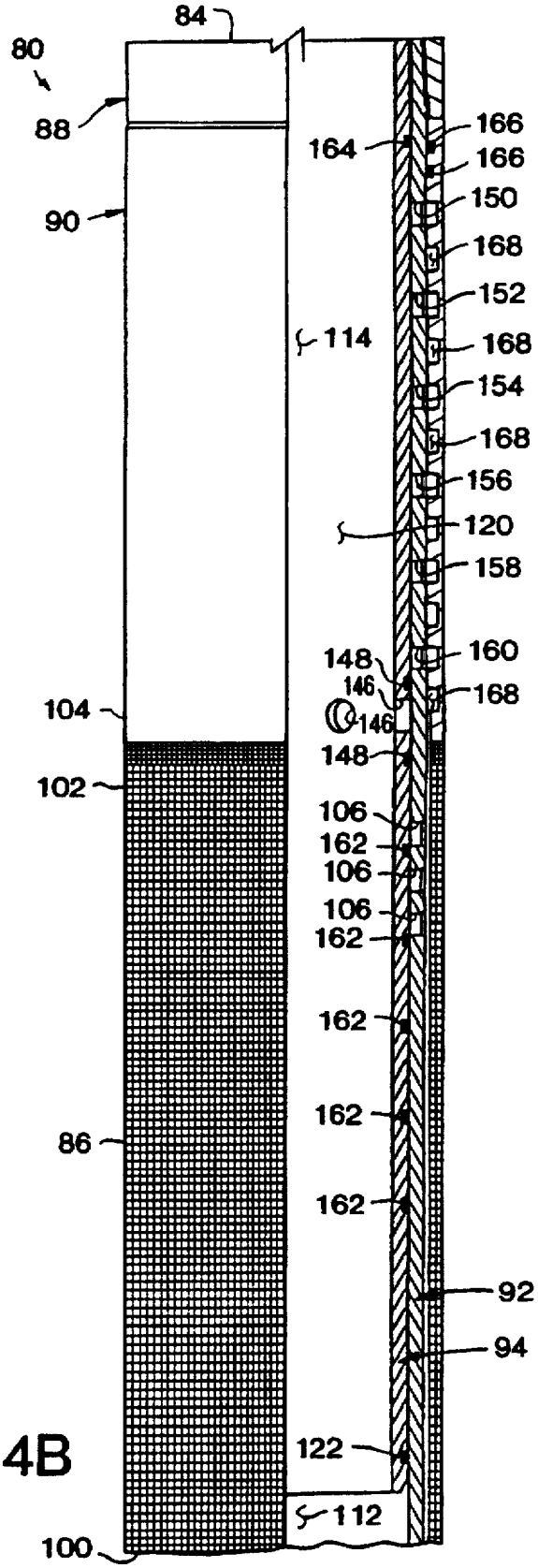

Illustrated in FIGS. 4A and 4B is the screen assembly 80 in a closed configuration thereof. Selector ports 146 are not axially aligned with any of ports 150–160. Ports 106 and 150–160 on the ported housing 92 are thus closed, the selector sleeve 94 radially inwardly overlapping each of the ports, and seals 164, 148, 162, and 122 sealingly engaging the ported housing and preventing radially inward fluid flow therethrough.

Shifting sleeve 96 has been axially downwardly displaced relative to the upper housing 88 as compared to the screen assembly 80 as shown in FIGS. 3A and 3B. Collets 126 now radially outwardly engage recess 142 on the upper housing 88. Selector sleeve 94 has thereby been axially downwardly displaced within the ported housing 92, such that seal 164 and an upper one of seals 148 axially straddle all of ports 150–160, preventing fluid flow radially inward therethrough.

With the screen assembly 80 in its closed configuration, flow is not permitted inwardly through the screen portion 86 into flow passage 120, but flow passage 120 may still be interconnected to other screen assemblies 80. The ability of each screen assembly 80 to be individually closed produces benefits in addition to those set forth above. For example, should the screen portion 86 on one screen assembly 80 fail, that screen assembly may be closed without affecting the ability to produce fluids through other interconnected screen assemblies. As another example, where multiple screen assemblies 80 are disposed opposite multiple formations, flow from one formation may be isolated for testing, treatment, etc., without affecting flow from other formations.

The foregoing detailed description is to be clearly understood as being given by way of illustration and example only, the spirit and scope of the present invention being limited solely by the appended claims.

What is claimed is:

1. Apparatus for variably restricting a flow rate therethrough of fluid from a fluid source, comprising:

a first elongated and generally tubular member having opposite ends and a circuitous flow passage formed on a side surface thereof, said circuitous flow passage having an effective resistance to flow therethrough and a plurality of axially spaced apart portions through which the fluid may flow, and each of said circuitous flow passage portions having a corresponding effective resistance to flow less than that of said circuitous flow passage; and a second elongated and generally tubular member coaxially disposed relative to said first tubular member and overlappingly disposed relative to said side surface thereof, said second tubular member having a sidewall portion and an opening formed through said sidewall portion, and said second tubular member being axially reciprocable relative to said first tubular member to position said opening axially opposite a selected one of said circuitous flow passage portions, whereby the flow rate of the fluid through the apparatus may be conveniently varied by positioning said opening axially opposite a selected one of said circuitous flow passage portions to thereby selectively vary the effective resistance to flow therethrough.

2. The apparatus according to claim 1, wherein said first tubular member further has a fluid flow path formed on one of said opposite ends, said fluid flow path being adapted to permit fluid communication between said circuitous flow passage and the fluid source.

3. The apparatus according to claim 1, wherein said circuitous flow passage comprises an axially extending helical recess formed on said first tubular member side surface, and wherein said circuitous flow passage portions comprise individual turns of said helical recess.

4. The apparatus according to claim 1, further comprising first and second circumferential seals disposed on said second tubular member sidewall portion, said first and second seals axially straddling said opening and being adapted to direct the fluid from said selected one of said circuitous flow passage portions to said opening when said opening is axially opposite said selected one of said circuitous flow passage portions.

5. The apparatus according to claim 1, wherein said second tubular member is positionable in a selected one of first, second, and third positions relative to said first tubular member, wherein when said second tubular member is in said first position said opening is not in fluid communication with said circuitous flow passage, and wherein when said second tubular member is in said second position said opening is in fluid communication with said circuitous flow passage.

6. Apparatus operatively positionable in a subterranean wellbore for adjusting a fluid flow rate through a screen, the apparatus comprising:

a tubular restrictor housing capable of sealing attachment to the screen, said restrictor housing having an axially extending flow passage formed thereon, and said flow passage being in fluid communication with an interior side surface of said restrictor housing;

a tubular ported housing coaxially disposed within said restrictor housing, said ported housing radially inwardly overlapping said restrictor housing and having first and second ports formed radially therethrough, said first port being in fluid communication with said flow passage, and said second port being fluid communicable with the screen; and a tubular selector sleeve coaxially disposed within said ported housing, said selector sleeve radially inwardly overlapping said ported housing and being in axially sliding engagement therewith, said selector sleeve having an opening formed radially therethrough, and said selector sleeve having a first closed position relative to said ported housing in which said opening is not axially aligned with either of said first and second ports, a second flow restricted position in which said opening is axially aligned with said first port, and a third open position in which said opening is axially aligned with said second port.

7. The apparatus according to claim 6, wherein said flow passage is formed on an interior side surface of said restrictor housing, and wherein an exterior side surface of said ported housing forms a radially inwardly disposed sidewall of said flow passage, said first port extending radially through said sidewall.

8. The apparatus according to claim 7, wherein said flow passage has a length greater than an axial length of said restrictor housing.

9. The apparatus according to claim 8, wherein said flow passage is helically formed on said restrictor housing interior side surface, said first port permitting fluid communication between said selector housing opening and a first turn of said helically formed flow passage when said opening is axially aligned with said first port.

10. The apparatus according to claim 9, further comprising a third port extending radially through said ported housing, said third port being axially spaced apart from said first and second ports and permitting fluid communication between said selector housing opening and a second turn of said helically formed flow passage, axially spaced apart from said first turn, when said opening is axially aligned with said third port.

11. A screen assembly operatively positionable in a subterranean well having a packer disposed therein, the screen assembly comprising:

a tubular upper housing having opposite ends and an interior side surface, one of said upper housing opposite ends being connectable to the packer, and said upper housing further having an axially spaced apart series of circumferential recesses formed on said upper housing interior side surface;

a tubular shifting sleeve having interior and exterior side surfaces, said shifting sleeve being coaxially and radially inwardly disposed relative to said upper housing, said shifting sleeve exterior side surface slidably engaging said upper housing interior side surface, and said shifting sleeve further having a circumferentially spaced apart series of collets formed thereon, said collets radially outwardly engaging a selected one of said upper housing circumferential recesses;

a tubular ported housing having opposite ends, interior and exterior side surfaces, and an axially spaced apart series of ports, each of said ports permitting fluid flow between said ported housing interior and exterior side surfaces, and said ported housing being coaxially disposed relative to said upper housing and extending axially outward therefrom, one of said ported housing opposite ends being attached to the other one of said upper housing opposite ends;

a tubular selector sleeve having opposite ends, an interior bore formed axially therethrough, an exterior side surface, and an opening permitting fluid flow between said selector sleeve exterior side surface and said interior bore, said selector sleeve being coaxially and radially inwardly disposed relative to said upper housing and said ported housing, said selector sleeve exterior side surface slidably engaging said ported housing interior side surface, one of said selector sleeve opposite ends being attached to said shifting sleeve for axial displacement therewith, and said selector sleeve opening being positionable axially opposite a selected one of said series of ports when said collets radially outwardly engage said selected one of said circumferential recesses;

a tubular screen radially outwardly and coaxially disposed relative to said ported housing, said screen being radially spaced apart from said ported housing and defining an annular space radially intermediate said ported housing and said screen, and said screen having opposite ends; and a tubular flow restrictor radially outwardly and coaxially disposed relative to said ported housing, said flow restrictor being sealingly attached to one of said screen opposite ends, and said flow restrictor being in fluid communication with said annular space.

12. The screen assembly according to claim 11, wherein said flow restrictor has an interior side surface, opposite ends, and a flow passage formed on said flow restrictor interior side surface, said flow passage extending axially inward from one of said flow restrictor opposite ends, said one of said flow restrictor opposite ends being sealingly attached to said one of said screen opposite ends, and said flow passage being in fluid communication with said annular space.

13. The screen assembly according to claim 12, wherein said flow passage is in fluid communication with said ported housing exterior side surface, and said flow passage further being in fluid communication with said selector sleeve opening when said selector sleeve opening is positioned axially opposite said selected one of said series of ports.

14. The screen assembly according to claim 11, wherein said series of ports includes a first port disposed axially opposite and radially inward from said screen, said first port being in fluid communication with said annular space, and fluid flow through said first port being permitted when said selector sleeve does not radially inwardly overlap said first port.

15. The screen assembly according to claim 11, wherein each of said series of ports is in fluid communication with a corresponding one of an axially spaced apart series of portions of a flow passage formed on said flow restrictor.

16. The screen assembly according to claim 15, wherein said flow passage is a radially outwardly recessed helix formed on an interior side surface of said flow restrictor, each of said portions of said flow passage comprising one of a series of axially spaced apart turns of said helix.

17. A method of varying the flow rate of a fluid, the method comprising the steps of:

providing a first tubular member having a circuitous flow passage formed thereon through which the fluid may flow, a portion of said flow passage being in fluid communication with a side surface of said first tubular member;

providing a second tubular member having an opening formed through a sidewall portion thereof;

coaxially and overlappingly disposing said second tubular member relative to said first tubular member side surface;

displacing said second tubular member relative to said first tubular member to thereby position said opening relative to said flow passage; and aligning said opening with said portion of said flow passage to permit fluid communication between said opening and said flow passage.

18. The method according to claim 17, further comprising the step of:

coaxially attaching a tubular screen to said first tubular member, said screen extending axially outward from said first tubular member, and forming therebetween an axial flow path in fluid communication with said flow passage.

19. The method according to claim 17, wherein said step of providing said first tubular member further comprises providing said first tubular member having said flow passage formed on an internal side surface thereof, and wherein said second tubular member disposing step further comprises disposing said second tubular member radially inward relative to said first tubular member.

20. A method of varying the flow rate of a fluid, the method comprising the steps of:

providing a first tubular member having a helically shaped flow passage comprising an axially spaced apart series of turns formed on an internal side surface thereof through which the fluid may flow, a portion of said flow passage being in fluid communication with a side surface of said first tubular member;

providing a second tubular member having an opening formed radially therethrough;

coaxially and overlappingly disposing said second tubular member radially inward relative to said first tubular member side surface;

axially displacing said second tubular member relative to said first tubular member to thereby position said opening relative to said flow passage; and axially aligning said opening with said portion of said flow passage by axially displacing said second tubular member relative to said first tubular member to axially align said opening with a selected one of said turns and permit fluid communication between said opening and said flow passage.

21. A method of adjusting a flow rate of fluid through a tubular screen disposed in a subterranean wellbore, the method comprising the steps of:

providing a tubular restrictor housing;

forming an axially extending flow passage on said restrictor housing, said flow passage being in fluid communication with an interior side surface of said restrictor housing;

sealingly attaching said restrictor housing to the screen;

providing a tubular ported housing having first and second ports formed radially therethrough;

coaxially disposing said ported housing within said restrictor housing, said ported housing radially inwardly overlapping said restrictor housing, said first port being in fluid communication with said flow passage, and said second port being in fluid communication with the screen;

providing a tubular selector sleeve having an opening formed radially therethrough;

coaxially disposing said selector sleeve within said ported housing, said selector sleeve radially inwardly overlapping said ported housing and being in axially sliding engagement therewith, such that said selector sleeve has a first closed position relative to said ported housing in which said opening is not axially aligned with either of said first and second ports, a second flow restricted position in which said opening is axially aligned with said first port, and a third open position in which said opening is axially aligned with said second port; and axially displacing said selector sleeve relative to said ported housing to a selected one of said first, second, and third positions.

22. The method according to claim 21, wherein said forming step further comprises forming said flow passage on an interior side surface of said restrictor housing, wherein said ported housing disposing step further comprises disposing an exterior side surface of said ported housing radially inward relative to said flow passage such that said ported housing exterior side surface forms a sidewall of said flow passage, and wherein said ported housing providing step further comprises forming said first port radially through said sidewall.

23. The method according to claim 21, wherein said flow passage forming step further comprises forming said flow passage having a length greater than an axial length of said restrictor housing.

24. The method according to claim 21, wherein said flow passage forming step further comprises helically forming said flow passage on said restrictor housing interior side surface, and wherein said axially aligning step further comprises permitting fluid communication between said selector housing opening and a first turn of said helically formed flow passage when said opening is axially aligned with said first port.

25. The method according to claim 21, wherein said ported housing providing step further comprises providing said ported housing having a third port extending radially through said ported housing, said third port being axially spaced apart from said first and second ports, and further comprising the step of axially aligning said opening with said third port to thereby permit fluid communication between said selector housing opening and a second turn of said helically formed flow passage, axially spaced apart from said first turn.

26. A method of completing a subterranean well having a wellbore intersecting a formation, the method comprising the steps of:

providing a first tubular screen;

providing a first tubular flow restrictor capable of adjusting a first flow rate of fluid through said first screen;

sealingly attaching said first screen to said first flow restrictor, said first flow restrictor extending axially outward from said first screen;

closing said first flow restrictor to thereby prevent fluid flow through said first screen;

inserting said first screen and said first flow restrictor in the wellbore;

positioning said first screen opposite the formation;

opening said first flow restrictor to thereby permit unrestricted fluid flow through said first screen; and adjusting said first flow restrictor to restrict fluid flow through said first screen such that said first flow rate is less than said first flow rate when said first flow restrictor is open, said adjusting step being performed after said inserting step.

27. The method according to claim 26, further comprising the steps of:

providing a second tubular screen;

providing a second tubular flow restrictor capable of adjusting a second flow rate of fluid through said second screen;

sealingly attaching said second screen to said second flow restrictor, said second flow restrictor extending axially outward from said second screen;

closing said second flow restrictor to thereby prevent fluid flow through said second screen;

sealingly attaching said second flow restrictor and said second screen to said first flow restrictor and said first screen;

inserting said second screen and said second flow restrictor in the wellbore;

positioning said second screen opposite the formation;

opening said second flow restrictor to thereby permit unrestricted fluid flow through said second screen; and adjusting said second flow restrictor to restrict fluid flow through said second screen such that said second flow rate is less than said second flow rate when said second flow restrictor is open, said adjusting step being performed after said second screen and second flow restrictor inserting step.

28. A method of completing a subterranean well having a wellbore intersecting a plurality of formations, the method comprising the steps of:

providing a plurality of tubular screens;

providing a plurality of tubular flow restrictors, each of said flow restrictors being capable of adjusting a flow rate of fluid through a corresponding one of said screens;

sealingly attaching each of said screens to one of said flow restrictors such that said flow rate through each of said screens is adjustable by a corresponding one of said flow restrictors, thereby forming a plurality of screen assemblies, each of said screen assemblies including a corresponding pair of said screens and said flow restrictors;

sealingly attaching said screen assemblies to each other;

closing one of said flow restrictors to thereby prevent fluid flow through a corresponding one of said screens;

inserting said screen assemblies into the wellbore;

opening said one of said flow restrictors to thereby permit unrestricted fluid flow through said corresponding one of said screens; and adjusting said one of said flow restrictors to restrict fluid flow through said corresponding one of said screens such that said flow rate is less than said flow rate when said one of said flow restrictors is open, said adjusting step being performed after said inserting step.

29. The method according to claim 28, further comprising the step of positioning each screen assembly opposite one of the formations.

30. Apparatus for variably restricting a flow rate therethrough of fluid from a fluid source, the apparatus comprising:

a first generally tubular member having a circuitous flow passage formed thereon, the circuitous flow passage including a plurality of flow passage portions; and a second generally tubular member having an opening formed through a sidewall portion thereof, the second tubular member being selectively positionable relative to the first tubular member to place the opening in fluid communication with a selected one of the flow passage portions.

31. A method of varying the flow rate of a fluid, the method comprising the steps of:

providing a first generally tubular member having a circuitous flow passage formed thereon, the circuitous flow passage including a plurality of flow passage portions;

providing a second generally tubular member having an opening formed through a sidewall portion thereof; and selectively placing the opening in fluid communication with one of the flow passage portions.

* * * * *